United States Patent [19]

Ferrage et al.

[11] Patent Number: 4,671,001

[45] Date of Patent: Jun. 9, 1987

[54] MACHINE FOR INSERTING FABRICS INTO A DRYING AND IRONING MACHINE

[75] Inventors: Francois Ferrage, La Riviere-de-Corps; Michel Adler, Bouilly, both of France

[73] Assignee: Establissements DUBIX (S.A.), France

[21] Appl. No.: 787,115

[22] Filed: Oct. 15, 1985

[30] Foreign Application Priority Data

Oct. 12, 1984 [FR] France ..... 84 15738

[51] Int. Cl.[4] ..... D06F 67/04; D06F 89/00

[52] U.S. Cl. ..... 38/143; 38/8; 271/175; 271/268; 271/275

[58] Field of Search ..... 38/143, 8; 271/275, 271/268, 175, 185; 198/681, 485.1; 414/753

[56] References Cited

U.S. PATENT DOCUMENTS

Re. 31,453 12/1983 Olsen et al. ..... 38/143
3,604,132 9/1971 Thompson ..... 38/143
4,299,521 11/1981 Jensen ..... 38/143
4,378,645 4/1983 Allen et al. ..... 38/8
4,437,247 3/1984 Wiebesiek ..... 38/143

*Primary Examiner*—Werner H. Schroeder
*Assistant Examiner*—Andrew M. Falik
*Attorney, Agent, or Firm*—Larson and Taylor

[57] ABSTRACT

A machine for inserting and taking up long and flat textile pieces into and from a drying and ironing machine comprises an oscillating outfit provided with a longitudinal beam, a slide fixed to this beam, two rolling pieces rolling in opposite directions and maintained in the slide, and two movable and symmetrically shaped carriages. Each of these carriages comprises a U-shaped rigid frame with opposed cheeks. One carriage bears a gripper for the prehension of the textile piece, and one of the two carriages is provided with an operating handle which bears a block which comes into friction contact against the edge of the longitudinal beam in order to maintain the front edge of the textile piece longitudinally tensioned.

5 Claims, 30 Drawing Figures

1
2
3
4
6
7
9
10
11
12
15
16
17
18
19
20
23
32
35
43
45
47
48
50
51
52
53
54
55
56
57
59
F1
F2
B
III
XX

MACHINE FOR INSERTING FABRICS INTO A DRYING AND IRONING MACHINE

FIELD OF THE INVENTION

The present invention relates to a machine for inserting long and flat fabrics, particularly bed-sheets, into a drying and ironing machine, especially into a drying, ironing and folding machine.

BACKGROUND OF THE INVENTION

It is well known that the modern drying and ironing machines for fabrics, comprise a drum on which the textile piece is stretched, dried and ironed by heating the drum or a heated half-cylinder surrounding the latter. The drum may be either fixed or rotating, according to the type of drying and ironing machine which is used. This machine is called "mural" when the intake and the extraction of the fabrics take place at the front part of the machine, which facilitates the operation. In this case, the textile piece is introduced from the top along the whole length of its front edge which is engaged by the endless bands of an introduction table. Then, it is applied on the drum and carried along by a travelling belt or by endless bands which are driven by planet-drums. When it is dried and ironed, the textile piece leaves the machine at its lower front part and it is collected in bulk in a frontal receiving container.

The applicant is the owner of the French Patent Application No. 80.07500/2.479.789 relating to a drying, ironing and folding machine wherein the dried and ironed textiles piece is folded longitudinally, i.e. along several folds parallel to the front edge before it is collected in said frontal receiving container. In particular, this drying, ironing and folding machine is provided with means for controlling the folding length "L", i.e. the distance between two successive folds, as a function of the length of the textile piece, whatever the travelling speed of this piece may be in the drying and ironing machine.

Whether the machine is a simple one or a drying, ironing and folding machine as mentioned hereinabove, the problem of the accurate introduction of the textile piece remains open, whether the machine belongs to the first or to the second type. In fact, this introduction is only accurate if it occurs silmultaneously all along the front edge of the piece. This require the front edge to be stretched between its ends and to make sure that both ends of this front edge are introduced simultaneously in the drying and ironing machine. The width (i.e. the length of the front edge) of the textile piece, and particularly of the bed-sheets, often amounts to 150 cm, and it is consequently difficult, if not impossible, for one single worker to carry out correctly the introduction of the sheet into the machine.

Several machines have been proposed which do not need the intervention of more than one worker. They make use of a movable outfit which is either oscillating (FR-A-No.1.415.903) or rotating (GB-A-No.2.022.623) or also moved in translation (FR-A-No.1.480.613), the first device using grippers which are moved by costly systems provided with jacks.

SUMMARY OF THE INVENTION

In a manner known from the above-identified patent FR-A-No.1.415.903, the machine according to the invention comprises, on the one hand, a table for introducing a textile piece into the drying and ironing machine, and, on the other hand, a mobile outfit which is mounted so as to oscillate between both side edges of the machine. The mobile outfit oscillates from a position (A) where the textile piece is engaged to another position (B) where the textile piece is received by the engagement table and vice versa. This outfit is therefore provided with two lateral cheeks, each being hinged at the ends of two lateral arms. The first cheek is integral with another arm for controlling the position of the outfit, and the second cheek is pivotally mounted on the contiguous edge of the machine. The length of these two arms, as well as the position of their pivots, determines the inclination of the outfit in each of these positions.

The machine according to the invention results from a quite different design, since the grippers are closed and moved manually. It is characterized by the fact that the movable outfit comprises a longitudinal beam whose ends are fixed to said side cheeks, a slide fixed to this beam, two rolling pieces rolling in opposite directions and maintained in the slide, and two movable and symmetrically shaped carriages. Each of these carriages comprising a U-shaped rigid frame with opposed cheeks, one of these cheeks facing the corresponding edge of the machine and bearing a gripper for the prehension of one of the ends of the front edge of the textile piece. The side of this frame, which constitutes a crossbar between said lateral cheeks, is fixed to one of the two rolling pieces. Thus, one of the two carriages is provided with an operating handle which is hinged between its lateral cheeks and returned by a return-spring to come into friction contact with the block carried by this handle against the edge of the longitudinal beam. The friction contact is sufficient for maintaining both carriages remote from one another and the front edge of the textile piece longitudinally tensioned between the two grippers.

Each of the two grippers has a novel design and is constituted by a lower jaw integral with the lateral cheek of the frame which bears it by an upper jaw and by a linkage by which the upper jaw is linked with the lower jaw and resiliently returned toward this jaw when the gripper closes by the tensioning of a deformable prism "P" constituted by the linkage. The linkage includes, each one of the next one, a square plate integral with the upper jaw, a plate bearing a hook for opening and closing the gripper, and a connecting plate hinged on the lower jaw. The machine is provided with means for releasing the textile piece from the movable outfit by opening both grippers, whatever the length of the textile piece may be. These means are constituted by a longitudinal and U-shaped corner-iron which may be operatively inclinable, which may pivot between both lateral edges of the machine and into which the hooks of the two closed grippers engage, these hooks taking a lower position and opening the grippers by forced tilting of the corner-iron.

In a preferred embodiment, the machine according to the invention comprises, in its lower part, a device for folding transversely the textile piece which has already been folded longitudinally when it leaves the drying, ironing and folding machine. A means allowing this machine to automatically determine the longitudinal folding length as a function of the variable length of the textile piece, before the longitudinal folding of the textile piece begins is also provided.

The invention will be better understood by referring to the following description and the attached drawings, which refer, by way of example, to its preferred embodiment.

DESCRIPTION OF THE PREFERRED EMBODIMENT

Figure 1:
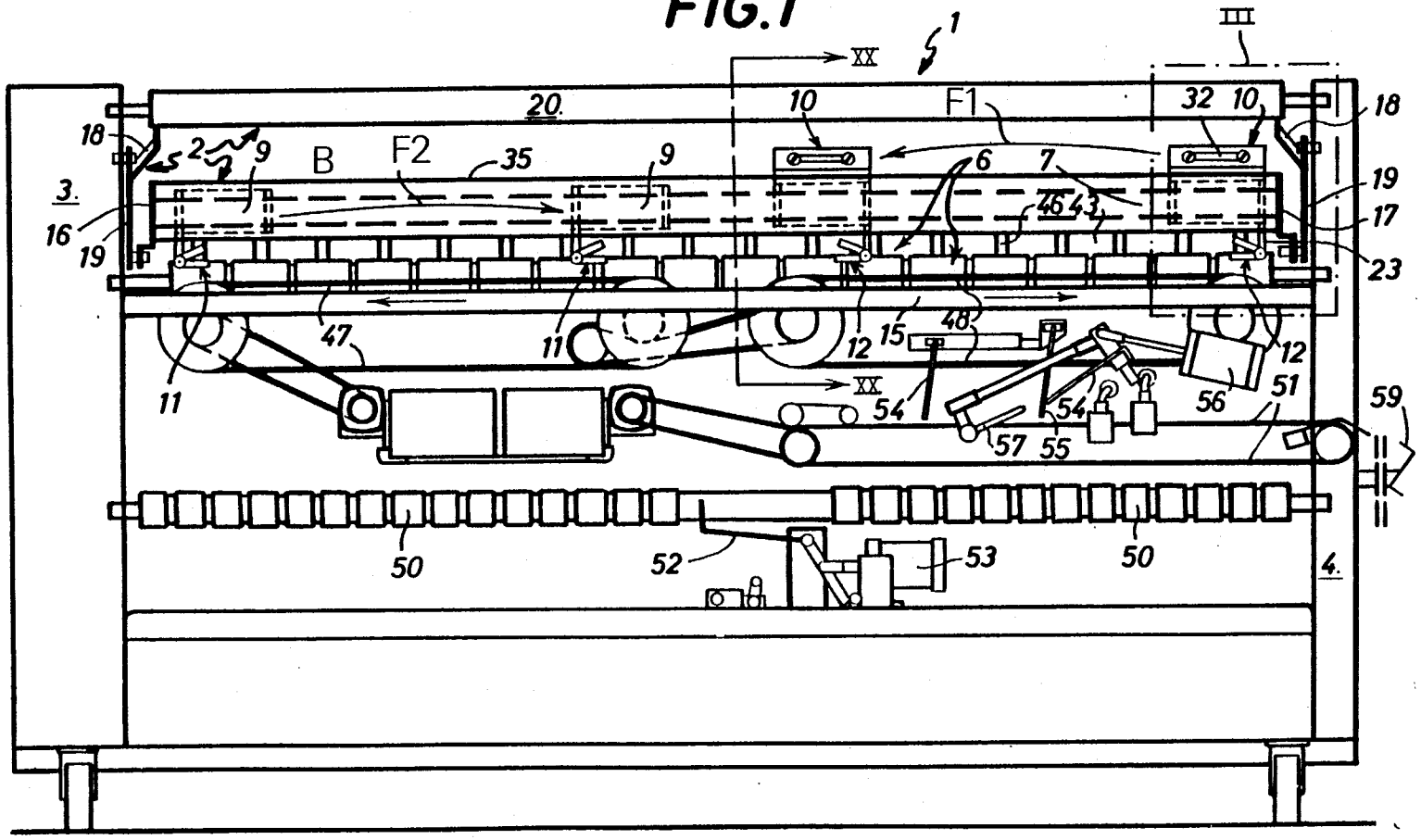
FIG. 1 shows a front view of the machine in the open position.
Figure 2:
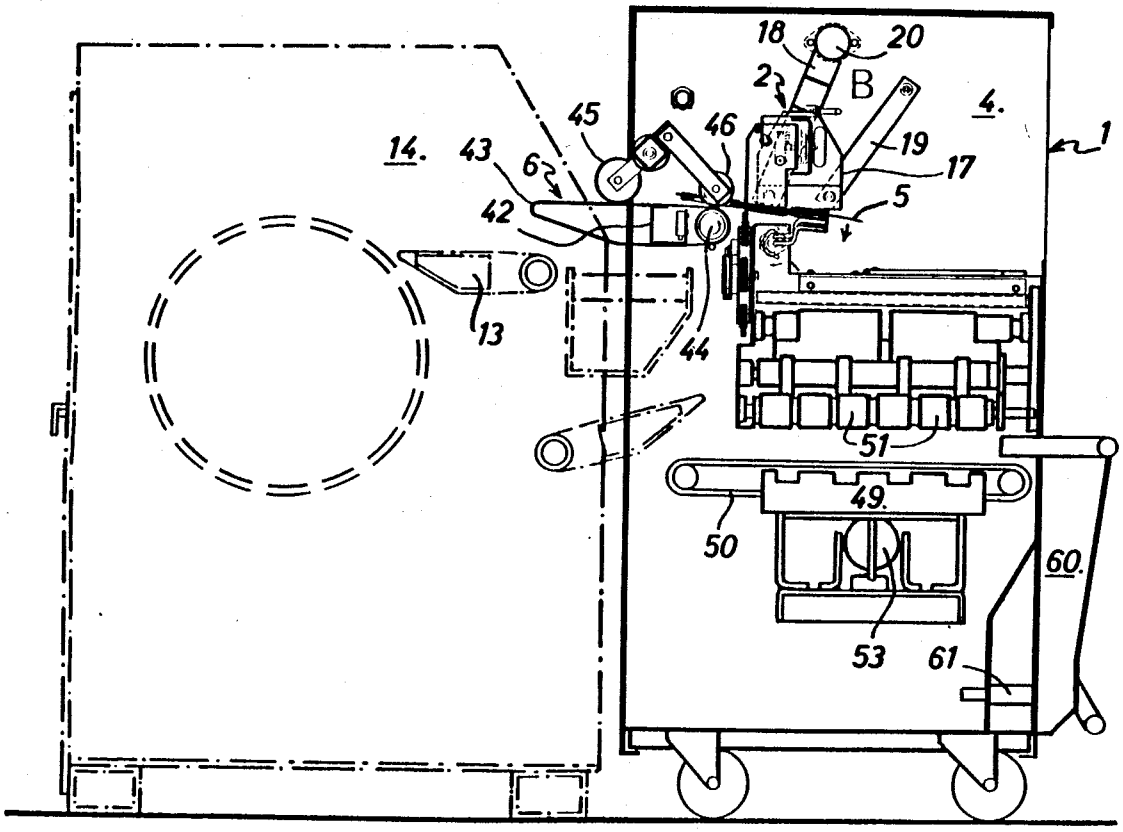
FIG. 2 shows this machine in median cross-section.

Referring first to FIGS. 1 and 2, the machine 1 comprises a movable outfit 2 which is mounted so as to be able to oscillate between its two side edges 3 and 4, from a position (A) for taking on the textile piece 5 to a position (B) for taking on this piece 5 by conveying engagement table 6, and vice versa.

This movable outfit 2 comprises a longitudinal beam 7 provided with a slide 8. Sliding in opposite directions on slide 8 are two carriages 9 and 10 bearing grippers 11 and 12, respectively, for gripping the ends of the front edge of the textile piece 5.

The purpose of the conveying engagement table 6 is to introduce to conveying table 13 of the drying and ironing machine 14 the textile piece 5 when the latter is released by the movable outfit 2 (FIG. 2).

The longitudinal beam 7 is carried by two lateral cheeks 16 and 17, each one being linked on the ends of two lateral arms 18 and 19. The first arm 18 is integral with a longitudinal shaft 20 controlling the position of the movable outfit 2. The second arm 19 is pivotally mounted on the adjacent lateral edge 4 of the machine 1. The length of each arm 18 and 19 and the position of their pivots determine the inclination of the movable outfit 2 in each of their extreme positions (A) and (B).

Both carriages 9 and 10, with symmetrical design, are constituted by a rigid U-shaped frame 21 with opposite side cheeks 22 and 23. One of these cheeks 23 faces the corresponding edge 4 of the machine 1 and carries a gripper 12 for gripping one of the ends of the front edge of the textile piece 5. The side 24 of said frame 21 constitutes a cross-bar between these two side cheeks and is fixed to a rolling member which is secured to the slide 8 wherein it can slide freely.

Figure 4:
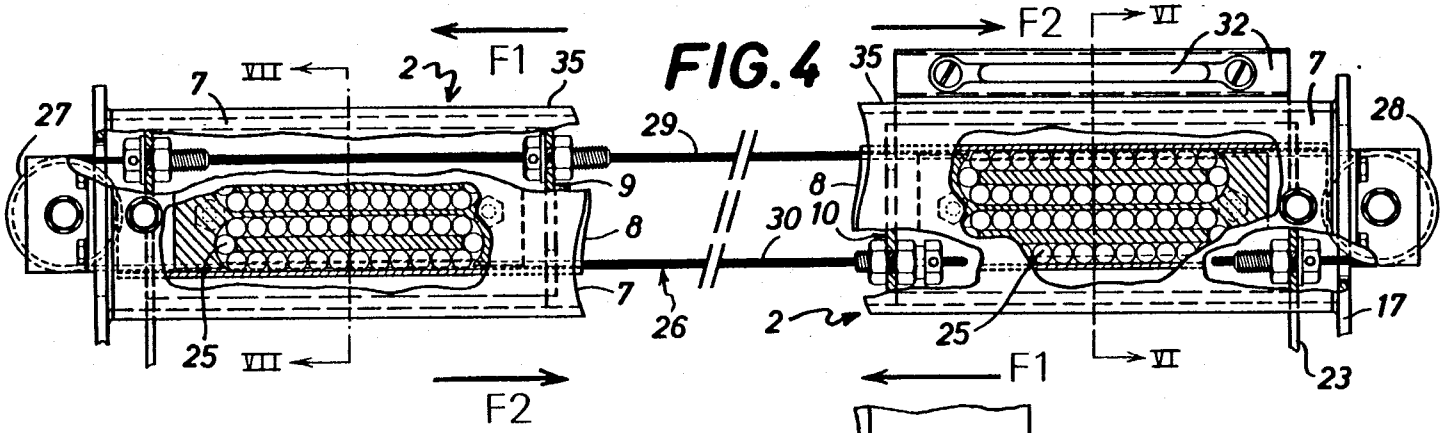
FIG. 4 is a front view, with a part thereof taken away, of the mutual lay-out of the two carriages which bear the grippers and the movement of which is opposite to one another.
Figure 5:
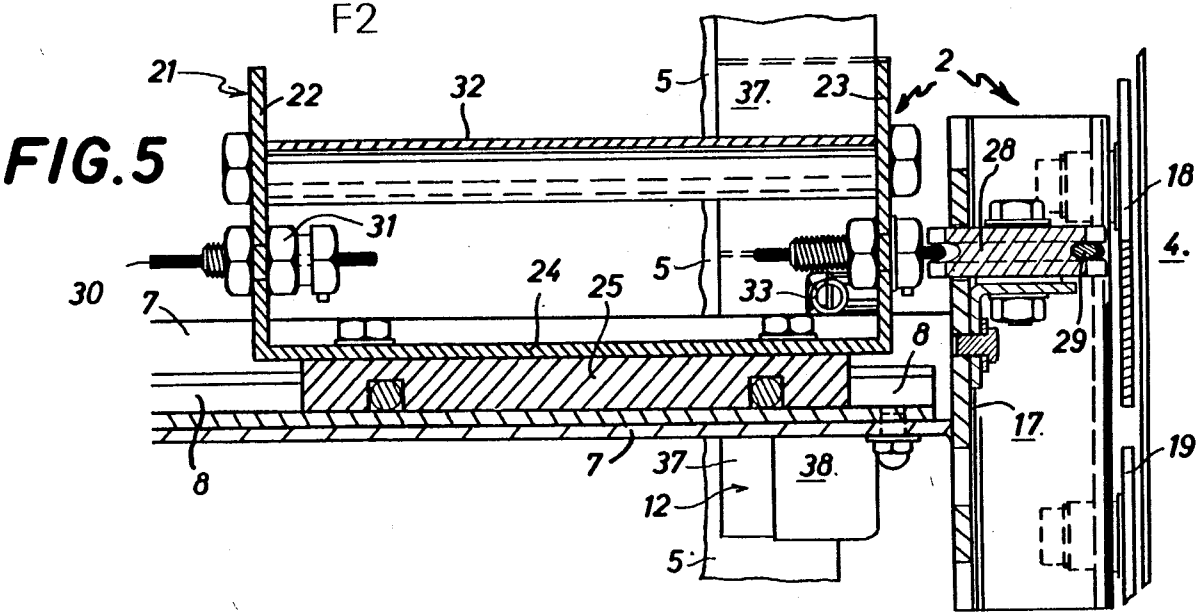
FIG. 5 is a partial horizontal cross-section along line V—V of FIG. 3.

This rolling member 25 is constituted by a sliding member, the general shape of which is rectangular (FIGS. 3, 4 and 5) and in which each large side forms a linear ball-bearing with a circular feed.

The sliding in opposite directions of both carriages 9 and 10 (FIG. 4) in the slide 8 (FIG. 5) takes place by means of a cable 26, or the like. Cable 26 is stretched in the form of a loop on and between two extreme pulleys 27 and 28, each of them being mounted loose on one side cheek 16 and 17. One strand 29 of the two strands of this cable 26 is integral with at least one of the two side cheeks of the frame 21 of one carriage 9 of the two carriages and passes freely through both cheeks of the other carriage 10. At least one cheek of carriage 10 is integral with the other strand 30 which passes freely through those of the first carriage 9. The movement of one of these carriages thus causes the movement of the other one in an opposite direction.

One strand 30 of the two strands of the cable 26 is integral with both side cheeks of the frame 21 of one carriage 10. This strand 30 is interrupted between these two cheeks in order to permit the adjustment of the tension of the cable 26.

Figure 3:
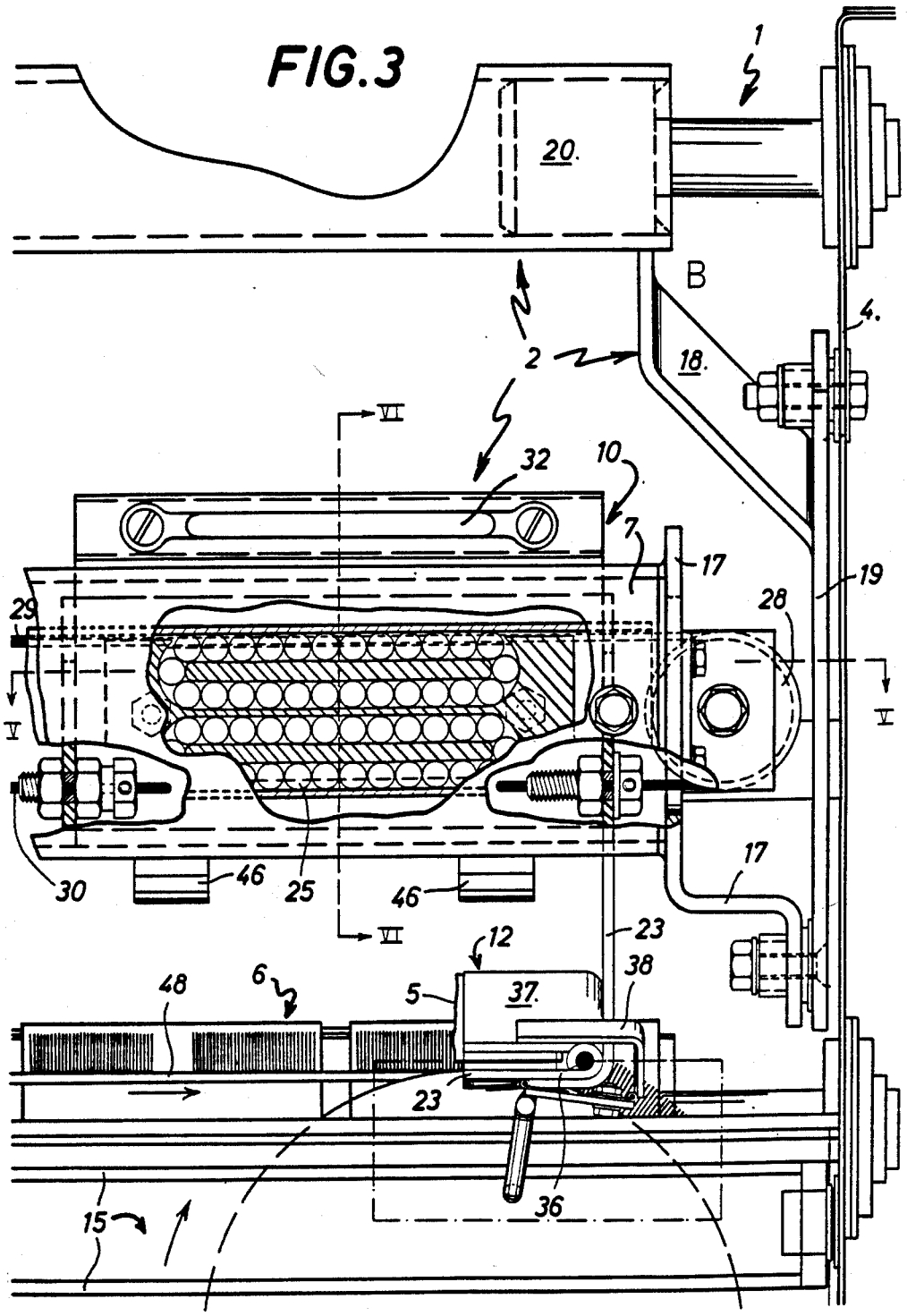
FIG. 3 is a partial enlargement, with parts taken away, of FIG. 1, according to the framed part of this FIG. 1.
Figure 6:
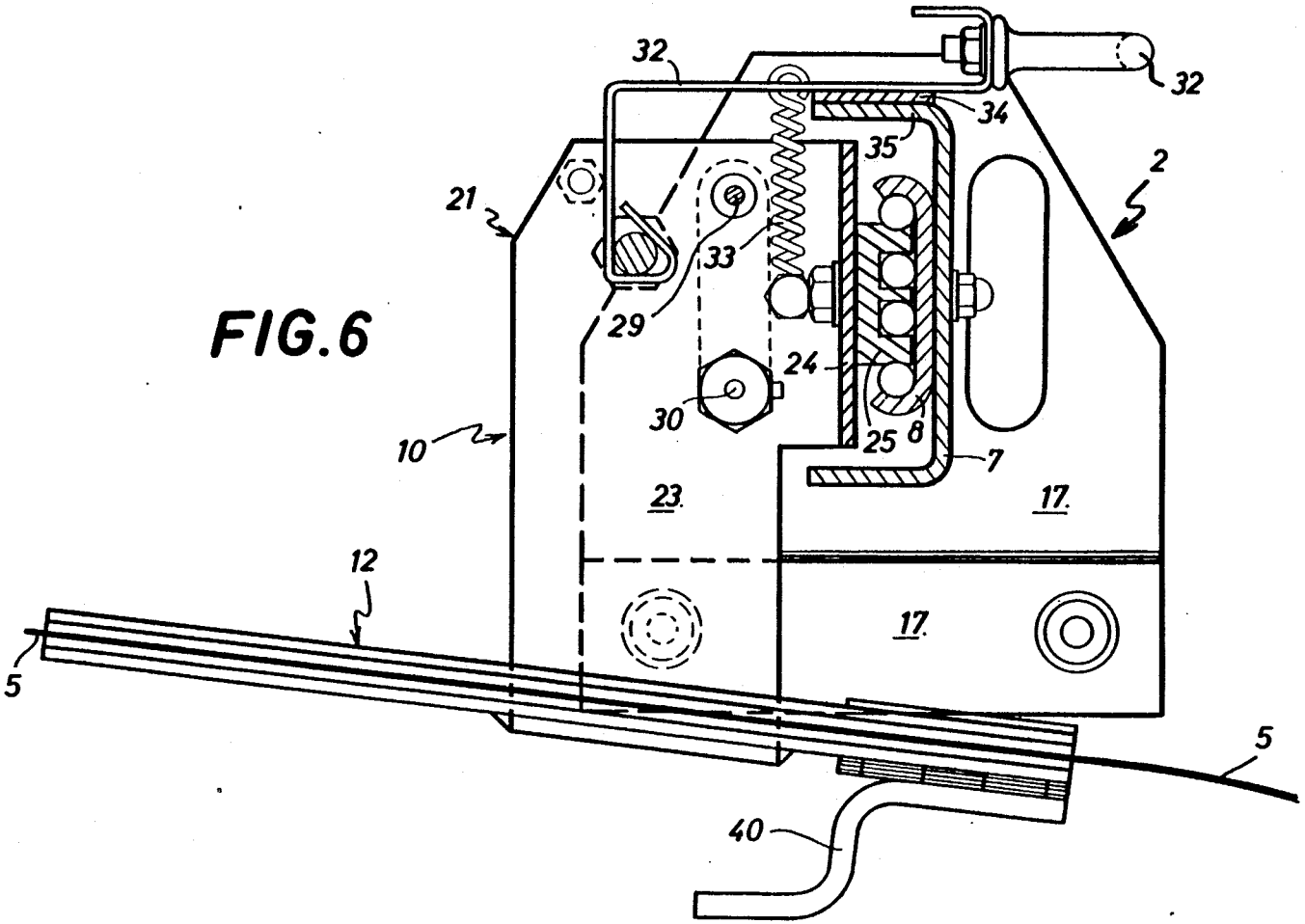
FIG. 6 is a transversal cross-section of the right-hand part of the movable outfit, along line VI—VI of FIGS. 3 and 4.
Figure 7:
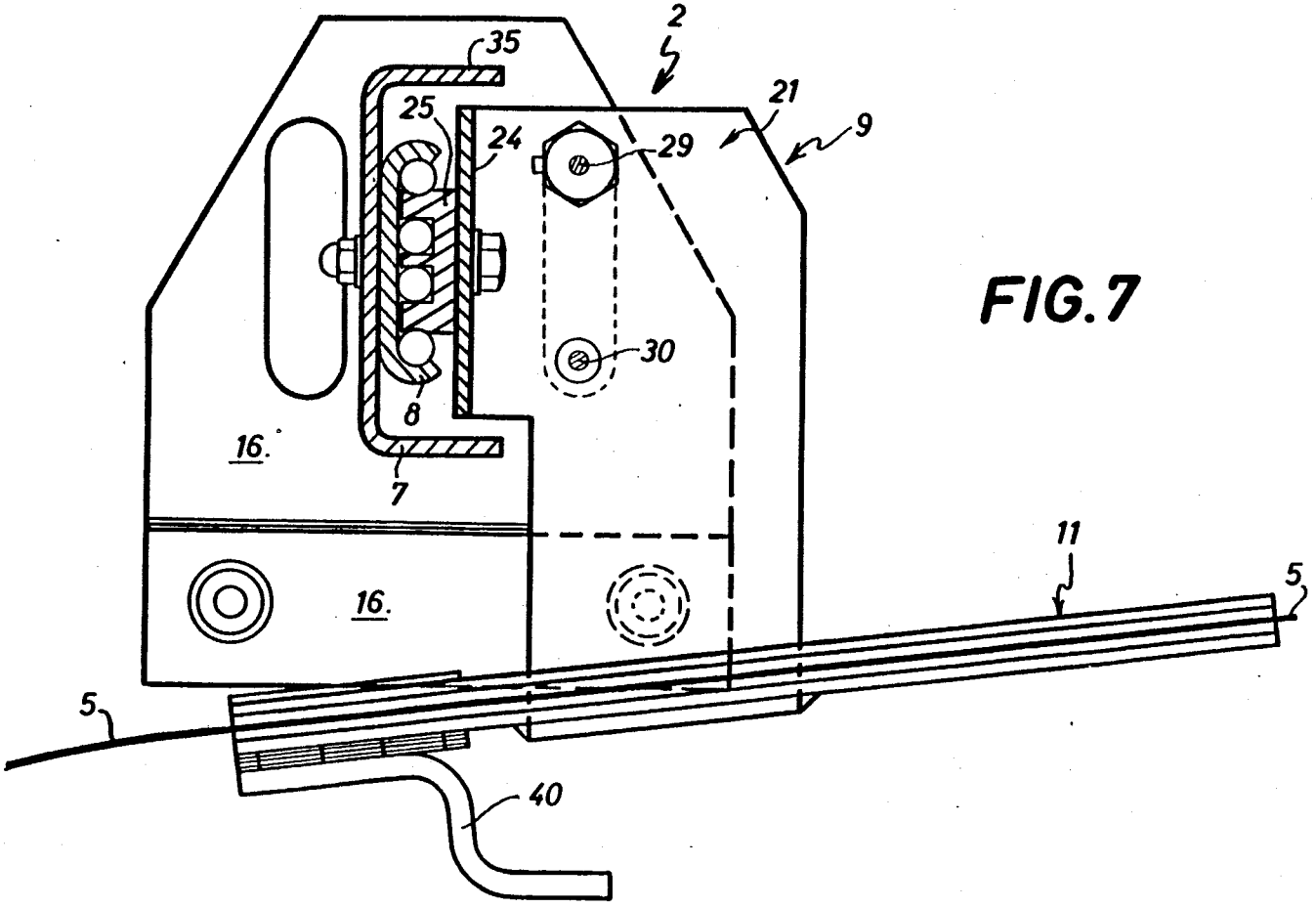
FIG. 7 is a transversal cross-section of the left-hand part of this movable outfit, along line VII—VII of FIG. 4.
Figure 8:
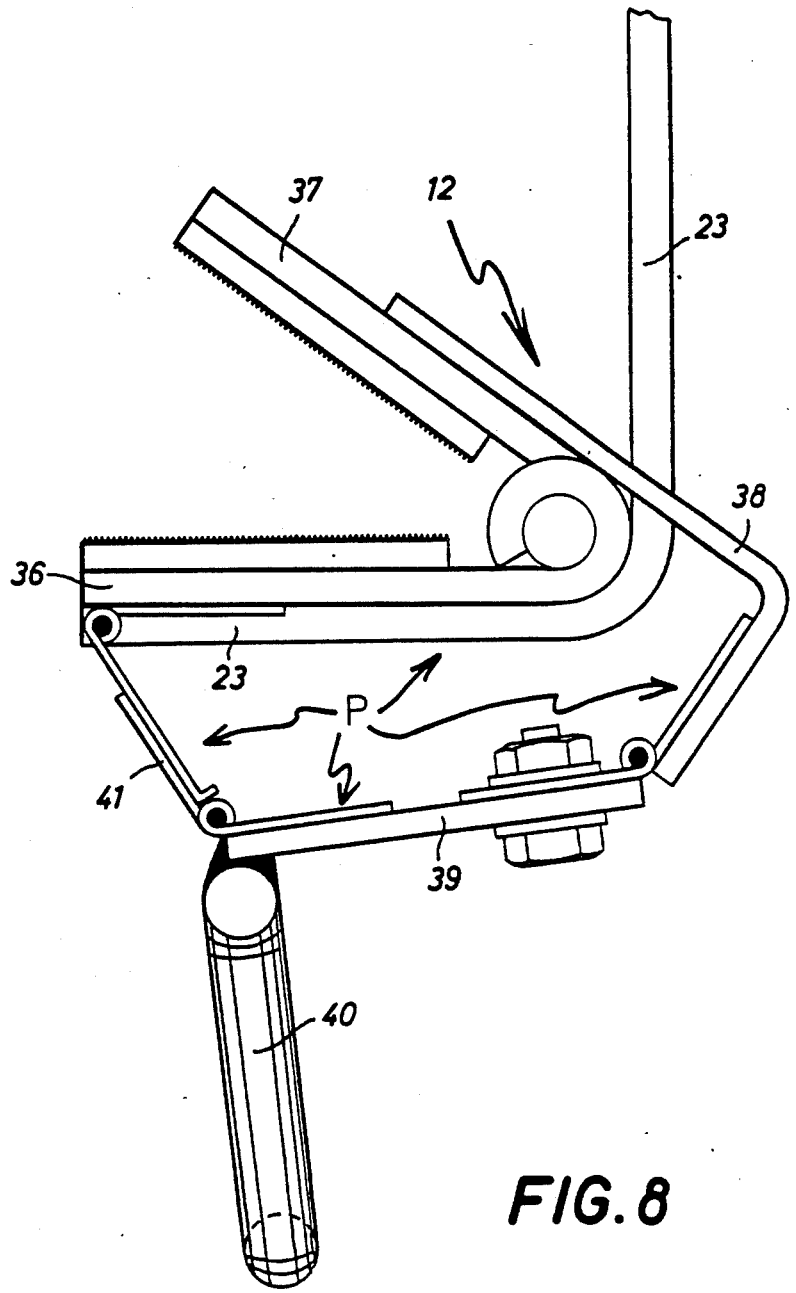
FIG. 8 shows a view taken from the end of the right gripper when it is open.
Figure 9:
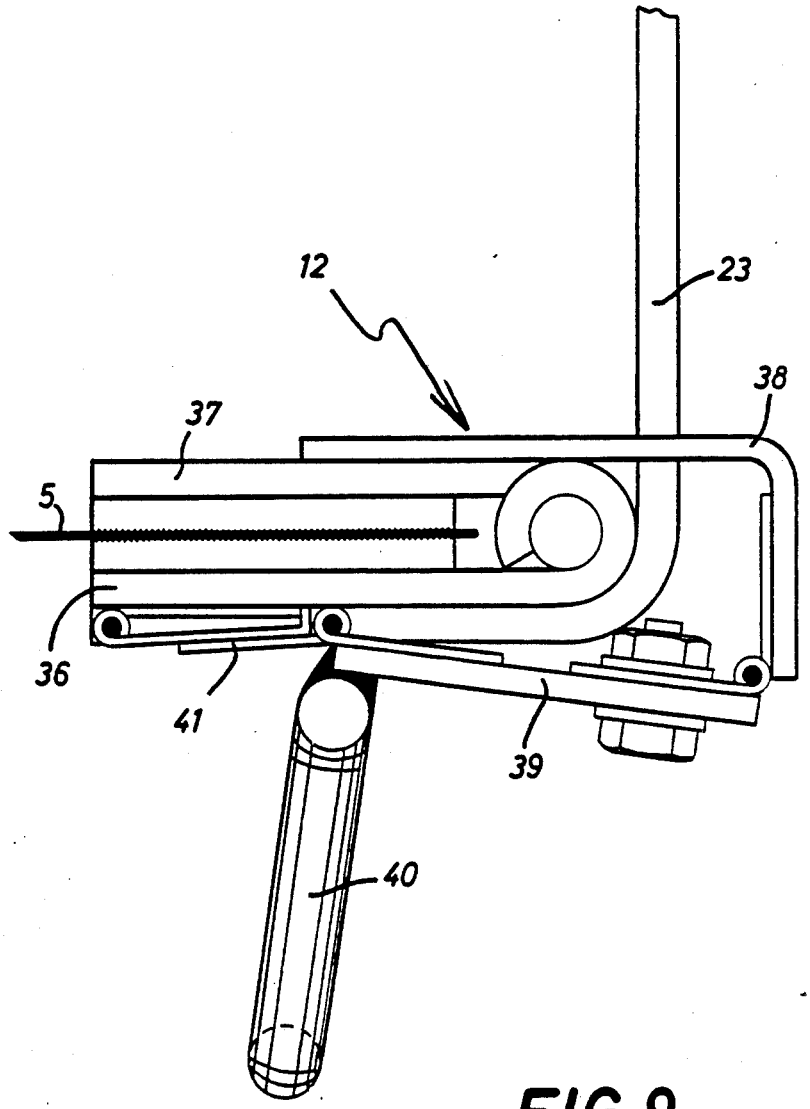
FIG. 9 shows a view taken from the end of the same gripper when it is closed.
Figure 10:
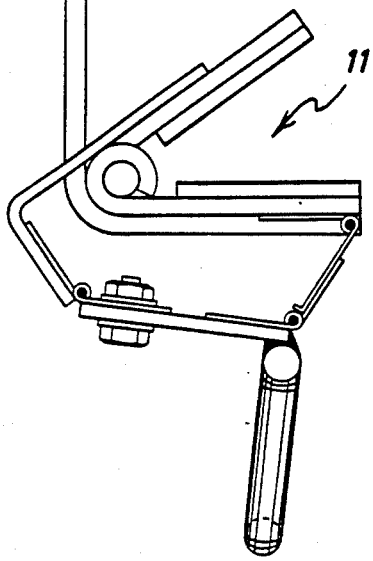
FIGS. 10 and 11 represent a view taken from the end of both grippers, respectively the left one and the right one, when they are open, and after both gripper-bearing carriages have been brought closer together in the direction of arrows F1 and F2, in order to grip the textile piece.
Figure 11:
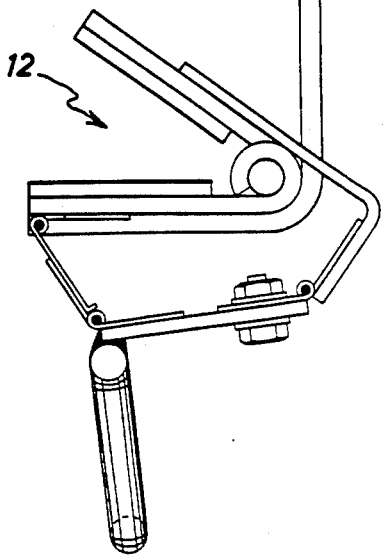
Figure 12:
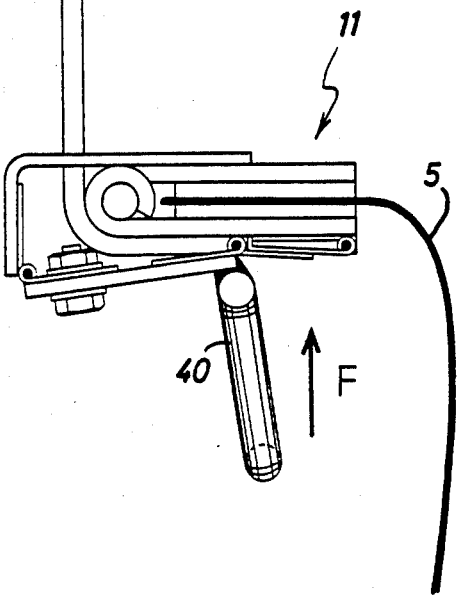
FIGS. 12 and 13 represent a view taken from the end of these grippers, respectively the left one and the right one, the first one being closed after it has engaged the left end of the front edge of the textile piece.
Figure 13:
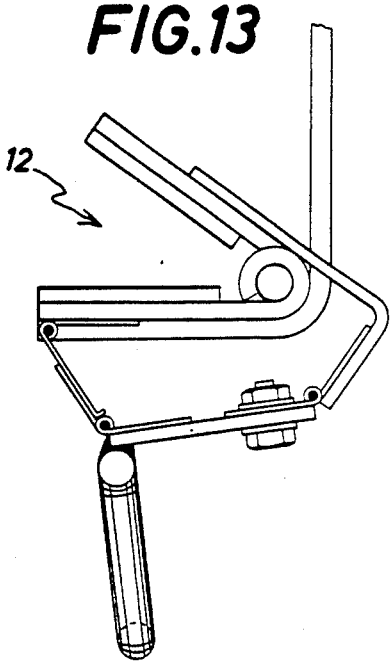
Figure 14:
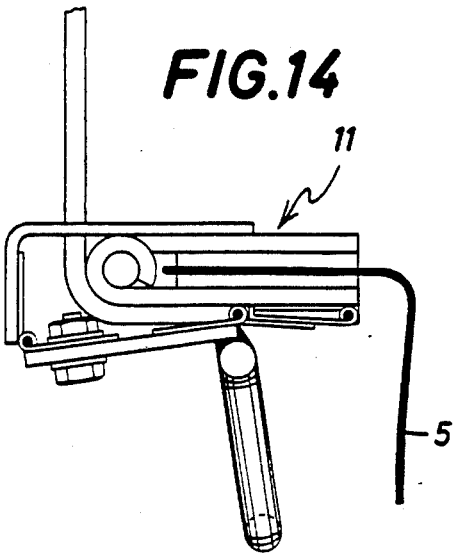
FIGS. 14 and 15 represent a view taken from the end of these two same grippers, respectively the left one and the right one, after the engagement of both ends of the front of the textile piece, but before the spacing of the two gripper-bearing carriages from one another.
Figure 15:
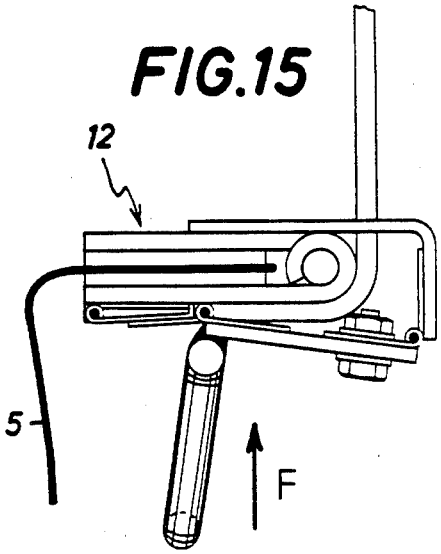
Figure 16:
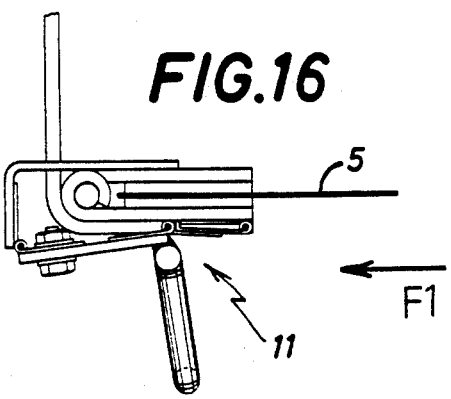
FIGS. 16 and 17 represent also a view taken from the end of these two grippers, respectively the left one and the right one, after their mutual spacing apart due to the displacement of both gripper-bearing carriages, the movable outfit being in the position (A) where the textile piece is engaged and its front edge stretched.
Figure 17:
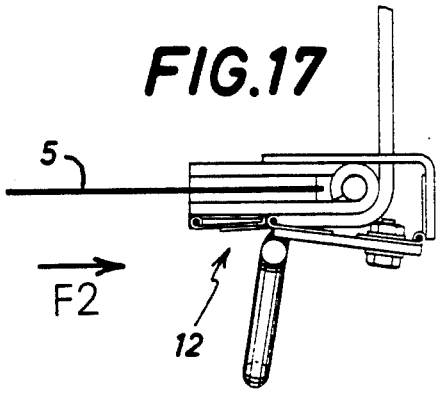
Figure 18:
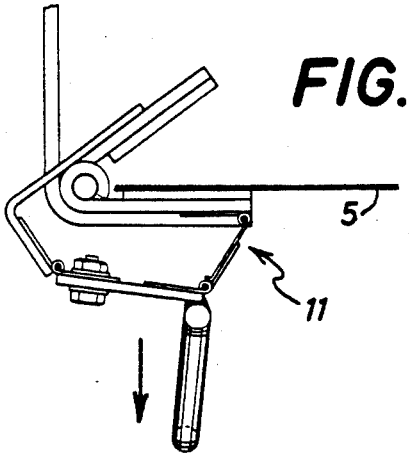
FIGS. 18 and 19 represent also a view taken from the end of these grippers, respectively the left one and the right one, mutually spaced apart after the simultaneous opening by forced tilting of the U-shaped longitudinal corner-iron, the movable outfit having been brought to the position (B) where the textile piece is engaged by the engagement table.
Figure 19:
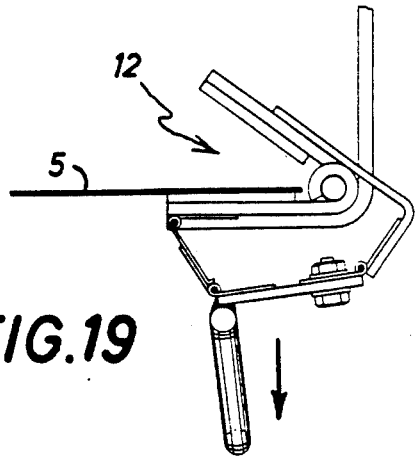
Figure 20:
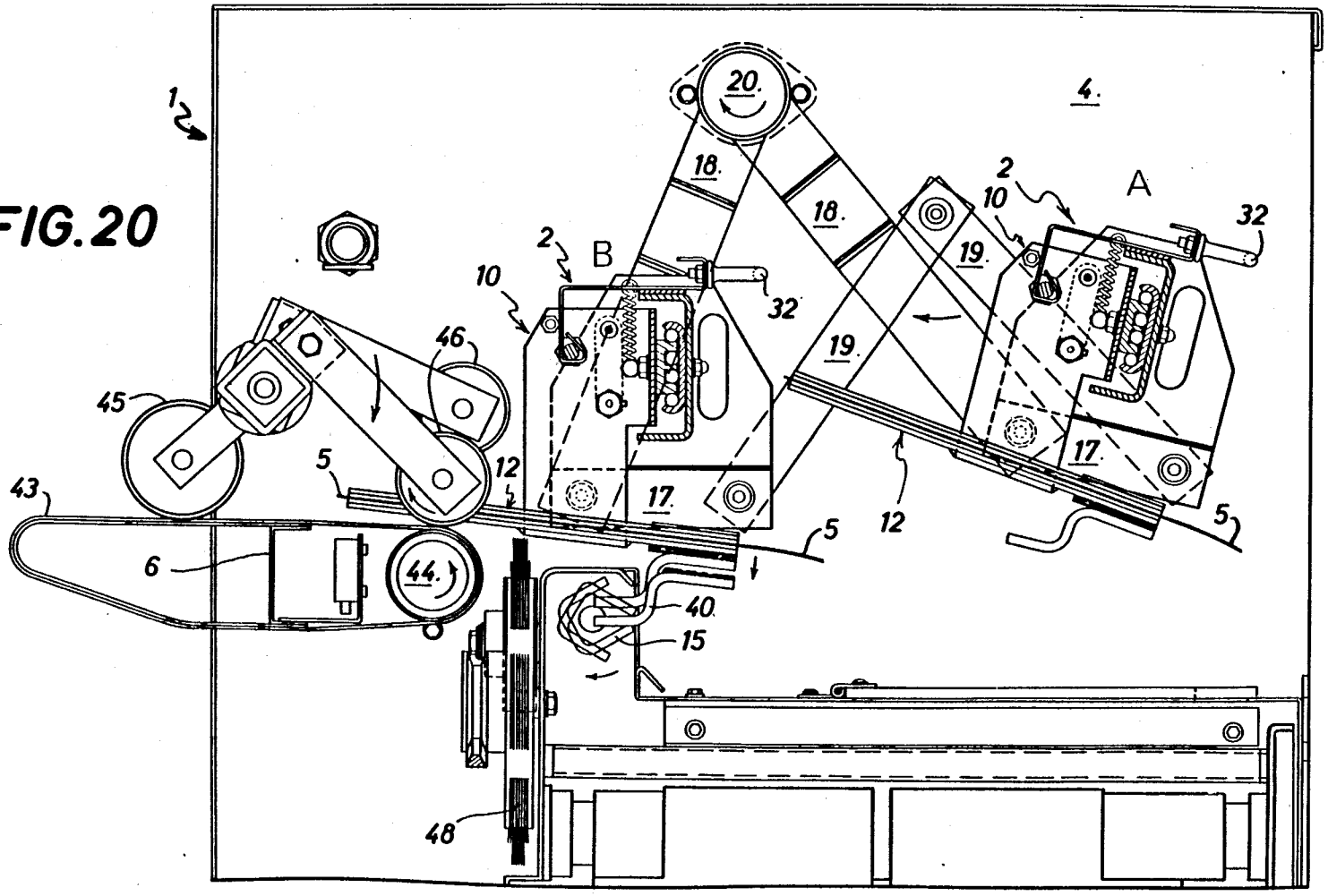
FIG. 20 shows a transversal cross-section along line XX—XX of FIG. 1.
Figure 21:
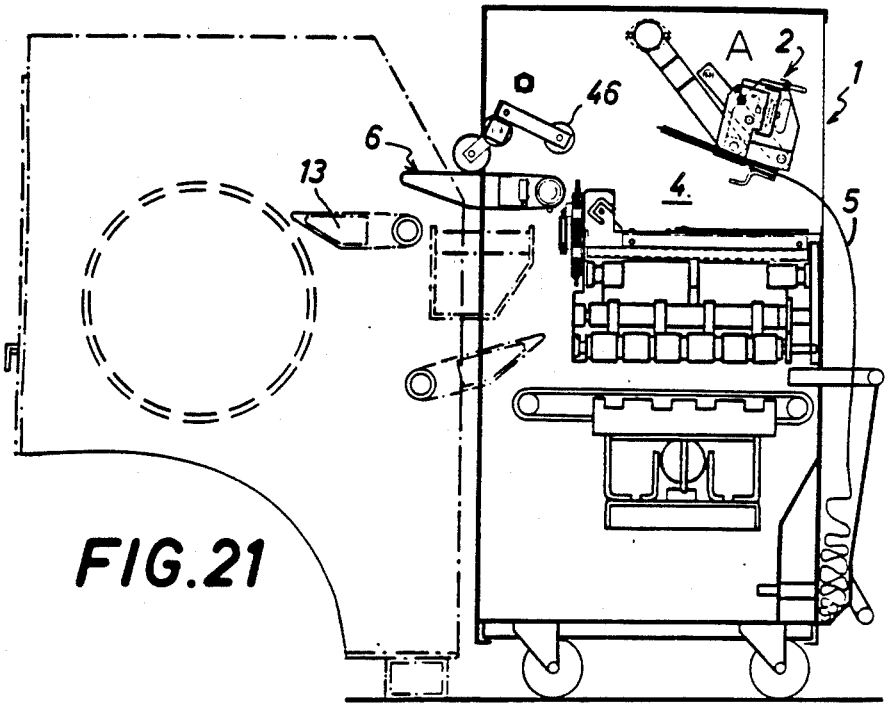
FIG. 21 is a transversal cross-section taken along the median plane of the machine, whereby the movable outfit is in the position (B) for the engagement of the textile piece.
Figure 22:
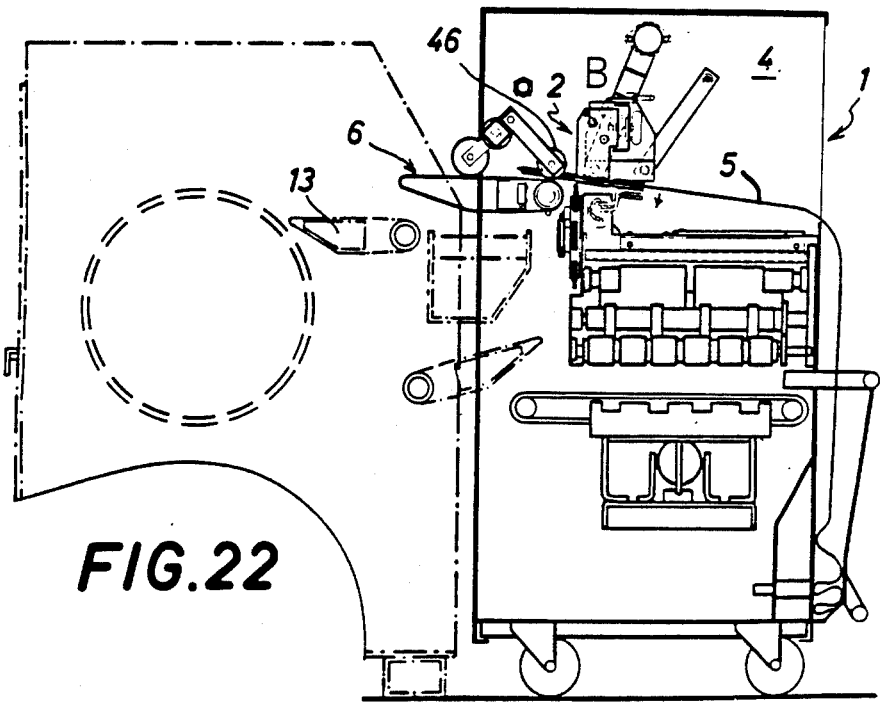
FIG. 22 is a transversal cross-section taken along the median plane of the machine, whereby the movable outfit is in the position (B) for the engagement of the textile piece by the engagement table.
Figure 23:
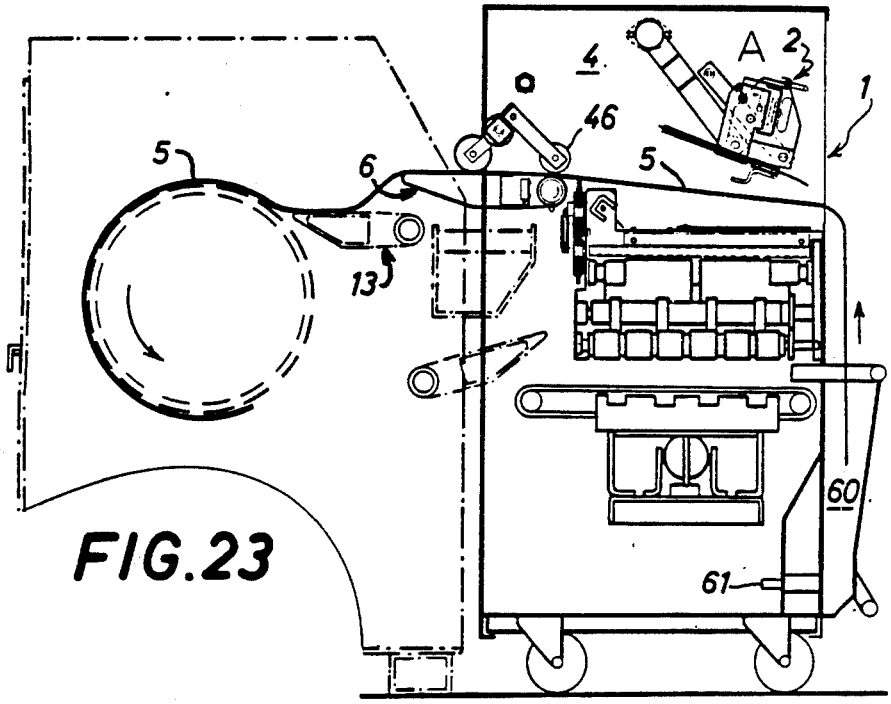
FIG. 23 is a transversal cross-section taken along the median plane of the machine, whereby the textile piece is engaged in order to be dried and ironed in the position (A) for taking on the next textile piece.
Figure 24:
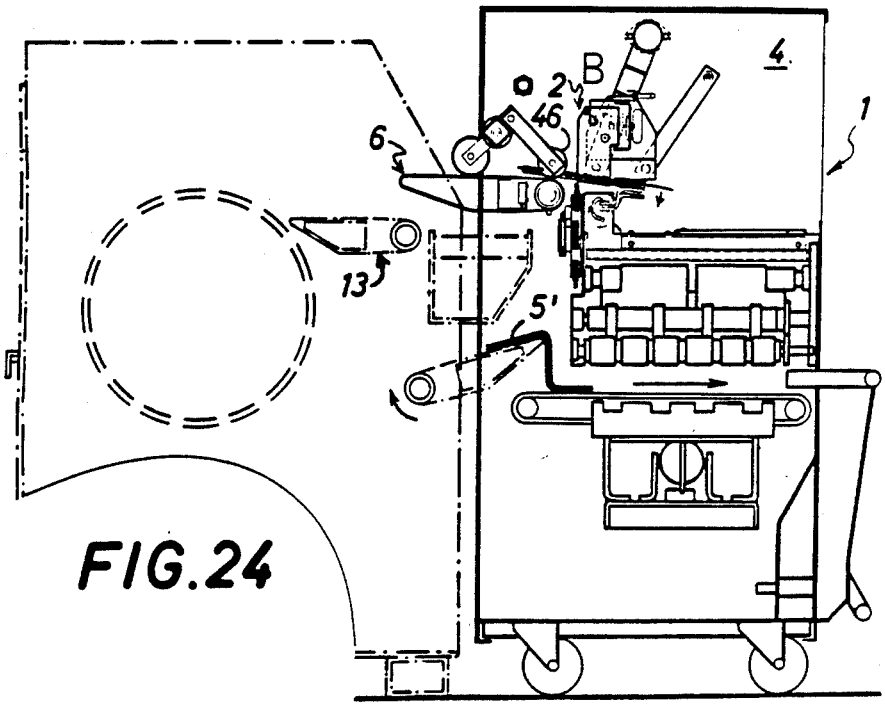
FIG. 24 is a transversal cross-section taken along the median plane of the machine, whereby the textile piece is folded longitudinally, leaves the drying, ironing and folding machine, and enters into the device for transversally folding which is included in the machine, the movable outfit being in the position (B) for the taking on of the textile piece by the engagement table.
Figure 25:
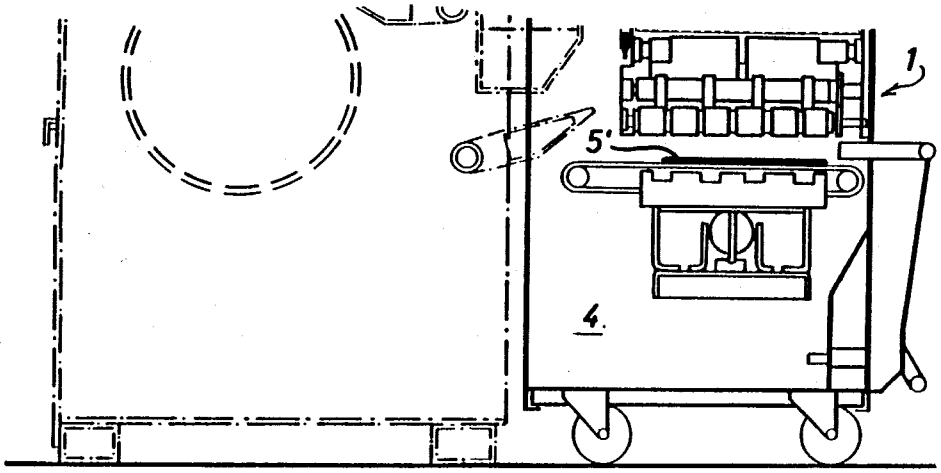
FIGS. 25 and 26 show the same device, respectively as a transversal cross-section taken along the median plane of this device and in a front view, the textile piece being introduced into said device after it has been folded longitudinally.
Figure 26:
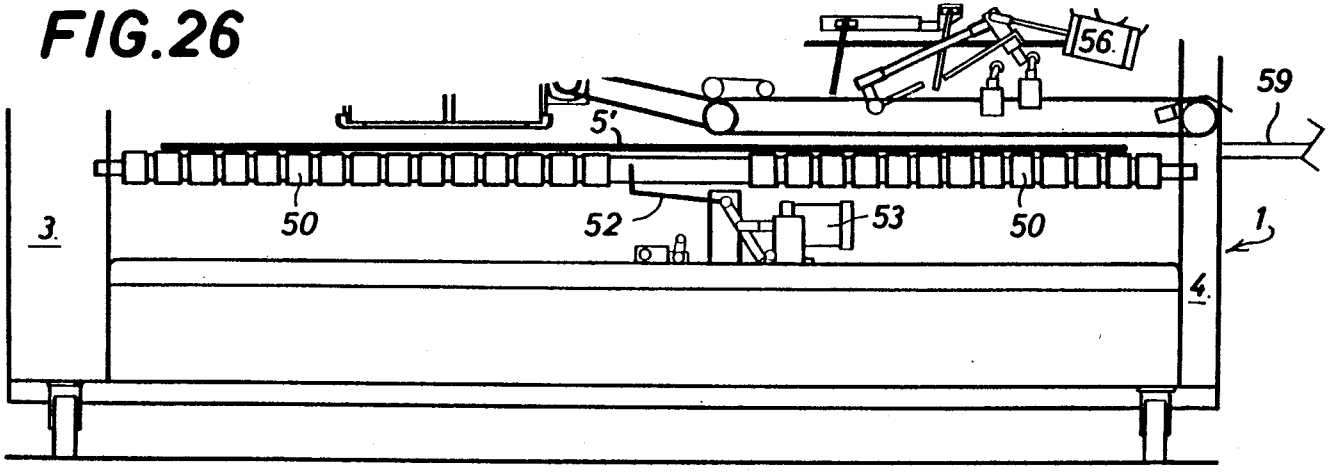

Referring now to FIGS. 3 and 6, one, 10 of the two carriages, actually the right one, is provided with an operating handle 32. Handle 32 is hinged between its lateral cheeks and returned by a return-spring 33 to come into friction contact with a block 34 carried by this handle against the upper edge 35 of the beam 7. This friction is sufficient for keeping both carriages 9 and 10 remote from one another and the front edge of the textile piece 5 being longitudinally tensioned between the two grippers 11 and 12.

Referring more particularly to FIGS. 8 to 19, each of the two grippers 11 and 12 have a symmetrical design. Each gripper is constituted by a lower jaw 36 integral with the lateral cheek 23 of the frame 21 of the carriage which carries it, and by an upper jaw 37 which is linked with the lower jaw 36 and resiliently returned towards the jaw when the gripper 12 closes. Upper jaw 37 is moved by tensioning of a deformable prism "P" (FIG. 8) constituted by the disclosed linking. This linking is comprised of a number of elements, each one on the next one, of a square plate 38 integral with the upper jaw 37, of a plate 39 carrying a hook 40 for opening and closing the gripper 12, and of a connecting plate 41 hinged on the lower jaw 36.

The engagement table 6 is formed with a structure 42 around which are stretched endless driving belts 43. Belts 43 are moved in translation around the structure 42 by a driving cylinder 44, and also by a set of pressing rollers 45, 46 which may be retractable (46), which rotate freely and which work solely by the action of the gravity.

The release of the textile piece 5 from the movable outfit 2 is caused, whatever the width of the textile piece may be, by a longitudinal U-shaped corner-iron 15. Corner-iron 15 may be operatively inclined and pivoted between both lateral edges 3 and 4 of the machine 1, and into which the hooks 40 of the grippers 11 and 12, when the latter are closed, come into engagement. The hooks 40, by forced tilting of this corner-iron 15, take a lower position and open the grippers 11 and 12.

Two belts 47 and 48, which carry brushes and which move longitudinally in opposite directions in a continuous manner, are located on both sides of the median plane of the machine 1, and symmetrically with respect to this plane, before the engagement table 6 and under the level of this table. By means of these brushes which touch it gently, the textile piece 5 is lightly tensioned and smoothed out.

Figure 27:
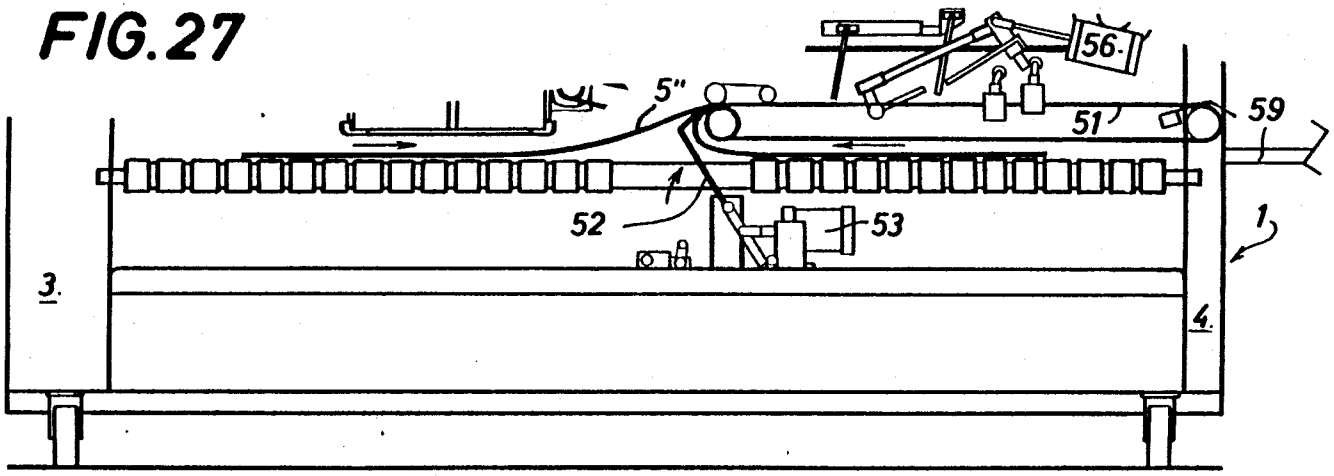
FIG. 27 represents a front view of this device during the carrying out of the first transversal fold of the longitudinally folded textile piece.
Figure 28:
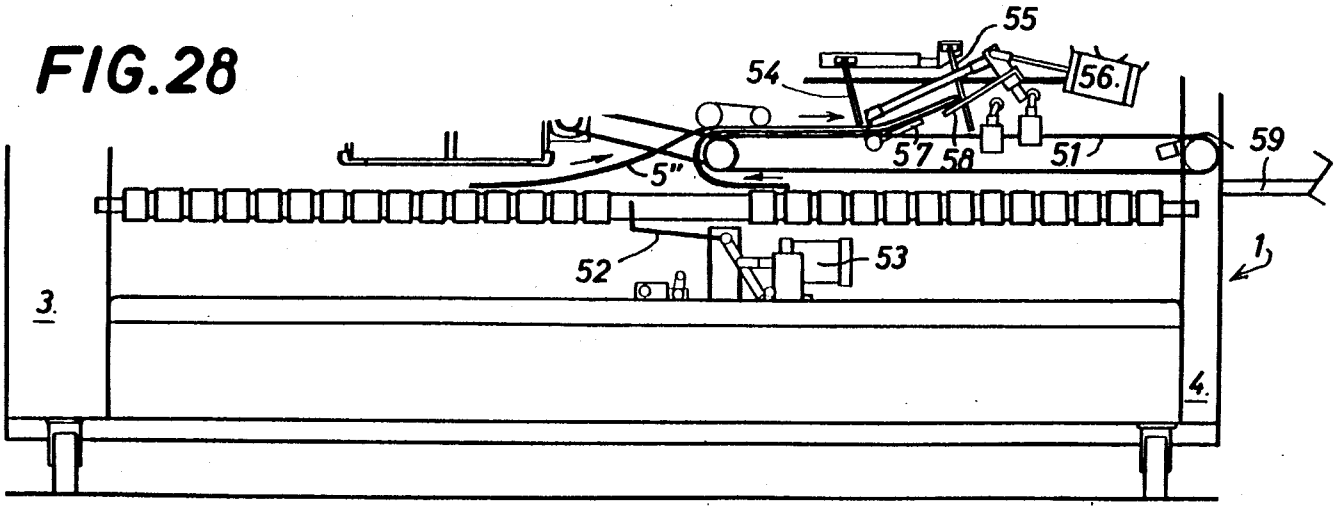
FIG. 28 represents a front view of this device during the preparation of the second transversal fold of the same longitudinally folded textile piece.
Figure 29:
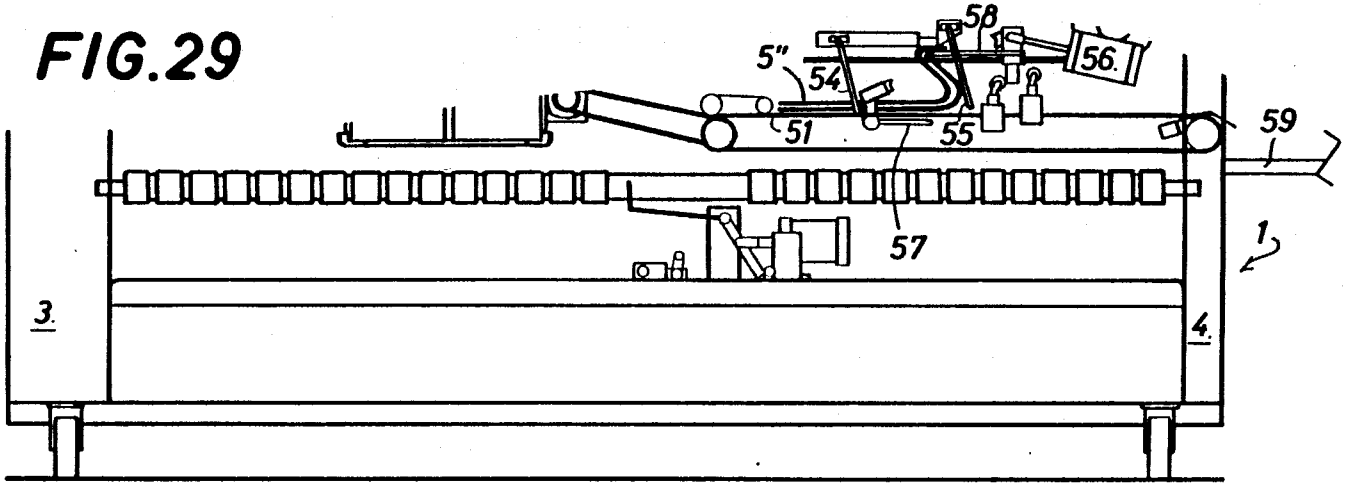
FIG. 29 represents a front view of this device during the carrying out of the second transversal fold of the longitudinally folded textile piece, and, FIG. 30 represents a front view of this device during the ejection from the right side of this device of the textile piece which is folded longitudinally and transversely.
Figure 30:
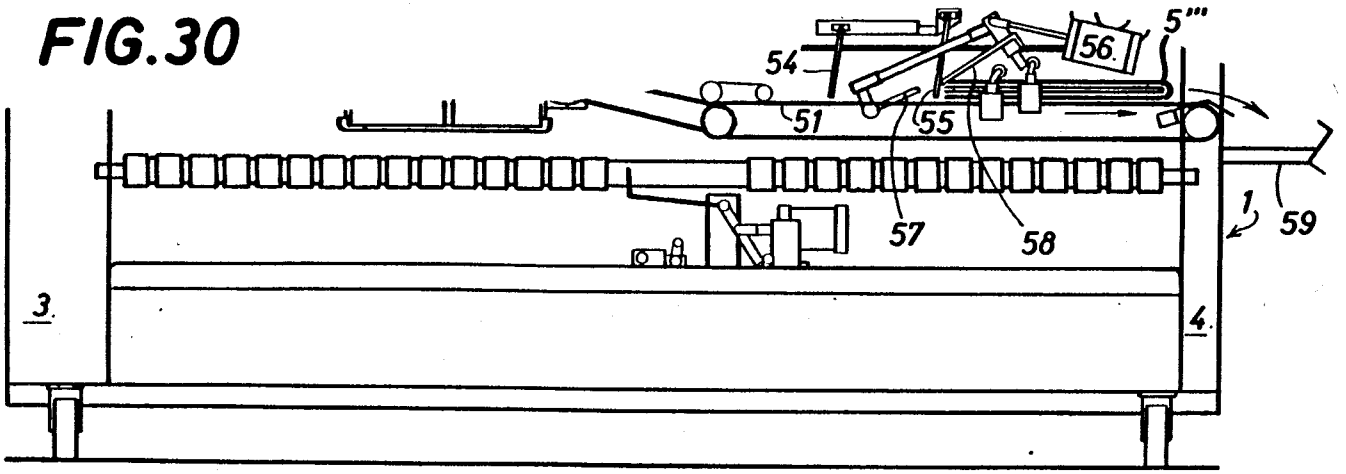

Used in a drying, ironing and folding machine 14 which carries out the longitudinal folding of the textile piece 5, the machine 1 is furthermore provided in its lower part with a device for folding transversely this textile piece which has already been folded longitudinally. This device comprises, on the one hand, a receiving table 49 with endless bands 50 on which the then longitudinally folded textile piece 5' leaving the drying, ironing and folding machine 14 takes its place in the flat condition, and, on the other hand, a table for transversal folding and for evacuating or conveying the textile piece. This table is formed with endless bands 51 which move longitudinally and extend above the receiving table on one half (here the right one) of the machine 1. The device further includes means to carry out the transversal folds of the textile piece 5'. This means comprises a tilting knife 52 with a control jack 53 which is located under the receiving table 49. Tilting knife 52 lifts the middle of this piece 5' during the formation of its first transversal fold, and introduces it on the evacuation table 51. Ihe means also includes two coupled paddles 54 and 55 capable of being oriented and which are located under the latter table 51. A system provided with jacks, and comprising two rocking paddles 57 and 58 which allow the lifting and the pinching (FIGS. 27, 28, and 29) of the textile pieces 5'' folded transversely one time and, consequently, the formation of the second transversal fold (FIG. 29) of the piece. When transversally folded (5''), the piece is conveyed by means of the bands 51 to a final receiving tank 59.

The machine 1 is provided with a tank 60 for the admission of the piece which is to be dried and ironed, and then to be folded. It is furthermore provided with a cell 61 for detecting the departure of the rear edge of this textile piece 5. This detection is transmitted to a counting unit belonging to the drying, ironing and folding machine 14. This allows the machine to determine automatically the folding distance between two consecutive longitudinal folds, as a function of the length of the introduced textile piece, this length being variable.

FIGS. 10 to 19 show how one single worker, after having initially brought closer to one another the grippers 11 and 12 (FIGS. 10 and 11) may engage the front edge of the textile piece 5 without the help of another person.

The worker tightens firstly the left end of the piece in the gripper 11 (FIG. 12) by closing the latter by acting on its hook 40 in the direction of the arrow F. He does then the same (FIG. 15) for the other end of this front edge of the textile piece 5, i.e. for its right end. He moves then aside from one another in the direction of the arrows F1 and F2 (FIGS. 16 and 17) the two carriages by acting only the handle 32 which is to be firstly lifted in order to allow the sliding of the carriages and then lowered in return as soon as said edge is stretched.

Afterwards, he starts the machine, and the movable outfit 2 passes from position A to position B, whereas the corner-iron 15 in which the hooks 40 of the grippers 11 and 12 have engaged lowers and opens the grippers. This releases the piece 5 now taken on by the engaging table by the lowering of the pressing rollers 46. Simultaneously, the movable outfit 2 is drawn in the position A and is ready for taking on another textile piece, whereas the preceding one goes its way through the machine and subsequently the drying, ironing and folding machine 14. The corner-iron returns then to the lowered position which it leaves only for receiving the hooks 40.

We claim:

1. An apparatus for inserting long and flat textile pieces, particularly bed-sheets, into a drying and ironing machine, which comprises:

an engagement conveying table for introducing the textile piece into the drying and ironing machine; and a movable outfit which is mounted so as to oscillate between two side edges of the apparatus between a position (A) where the textile piece is engaged and another position (B) where this textile piece is engaged by the engagement table, the outfit being therefore provided with two lateral cheeks, each one being hinged at the ends of two side arms, the first one being integral with another longitudinal arm for controlling the position of th outfit, and the second one being pivotally mounted on the contiguous edge of the machine, whereby the length of these two arms, as well as the position of their pivots, determine the inclination of the outfit in each of these positions, this machine being characterized in that the movable outfit comprises:

a longitudinal beam the ends of which are fixed to said lateral cheeks, a slide fixed to the beam, two rolling pieces rolling in opposite directions and maintained in the slide, and two movable and symmetrically shaped carriages, each of these carriages comprising a U-shaped rigid frame with opposed cheeks, one of these opposed cheeks facing the corresponding edge of the machine and bearing a gripper for the prehension of one of the ends of the front edge of the textile piece, and whereas a side of this U-shaped frame which constitutes a cross-bar between said lateral cheeks is fixed to one of the two rolling pieces, whereby one of the two carriages is provided with an operating handle which is hinged between its lateral cheeks and returned by a return-spring to come into friction contact against a block carried by this handle against the edge of the longitudinal beam, the friction contact being sufficient for maintaining both carriages spaced apart from one another, and the front edge of the textile piece being longitudinally tensioned between the two grippers.

2. An apparatus as claimed in claim 1, in which the two grippers have a symmetrical design and each one comprises (a) a lower jaw integral with the lateral cheek of the frame which bears it, (b) an upper jaw, and (c) a linkage by which the upper jaw is linked with the lower jaw and resiliently returned towards the lower jaw when the gripper closes by the tensioning of a deformable prism constituted by the linkage, the linkage including, a square plate integral with the upper jaw, a plate carrying a hook for opening and closing the gripper connected to the square plate, and a connecting plate connected to the last-mentioned plate and linked to the lower jaw, the apparatus being furthermore provided with means for releasing the textile piece from the movable outfit by opening both grippers, whatever the length of the textile piece may be, said means being constituted by a longitudinal and U-shaped corner-iron which may be operatively inclined and pivoted between both lateral edges of the apparatus and into which the hooks of the two closed grippers engage, which hooks lower and open the grippers by forced tilting of the corner-iron.

3. An apparatus as claimed in claim 1, in which each one of the two rolling pieces is constituted by a sliding member, the general shape of which is rectangular and in which each large side forms a linear ball-bearing with a circular feed.

4. An apparatus as claimed in claim 1, used in cooperation with a drying and ironing machine which also carries out a longitudinal folding of the textile piece delivered thereto, said apparatus further comprising in its lower part a device for folding transversely the textile piece which has already been folded longitudinally by the machine, said device comprising, (a) a receiving conveying table with endless bands on which the longitudinally folded textile piece leaving the drying, ironing and folding machine is delivered flat, (b) a folding conveying table for folding transversely and for conveying the textile piece, this folding table being formed by endless bands which move longitudinally and extend above the receiving table on one half of the apparatus, and (c) means for carrying out the transversal folds of the longitudinal folded textile piece, said means comprising a tilting knife with a control jack which is located under the receiving table, which knife lifts the middle of the piece during the formation of its first transversal fold and which then introduces the piece on the folding table, two coupled paddles which are orientatable and which are located under the folding table, and a system provided with jacks and comprising two rocking paddles which allow the lifting and the pinching of the once transversely folded textile piece and subsequently the formation of a second transversal fold on the textile piece which is then conveyed by means of bands to a final receiving tank.

5. An apparatus as claimed in claim 1, including a tank for the storage of the textile piece which is to be dried, ironed and folded, and a cell for detecting the departure of the rear edge of this textile piece from the tank whereby this detection is transmitted to a counting unit provided with the drying and ironing machine which allows the machine to determine automatically the distance between two consecutive longitudinal folds as a function of the length of the textile piece.

* * * * *